US007975637B1

(12) United States Patent
Nida

(10) Patent No.: US 7,975,637 B1
(45) Date of Patent: Jul. 12, 2011

(54) TEMPERATURE CONTROL SYSTEM FOR A HYBRID VEHICLE

(75) Inventor: Nicholas E. Nida, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 54 days.

(21) Appl. No.: 12/701,713

(22) Filed: Feb. 8, 2010

(51) Int. Cl.
*B63J 2/00* (2006.01)

(52) U.S. Cl. ..... 114/211; 440/6; 440/88 HE

(58) Field of Classification Search ..... 114/211; 440/6, 88 HE
See application file for complete search history.

(56) References Cited

U.S. PATENT DOCUMENTS

| | | | | |
|---|---|---|---|---|
| 4,898,325 | A | 2/1990 | Sakurada | |
| 4,899,809 | A | 2/1990 | Takenaka et al. | |
| 5,042,566 | A | 8/1991 | Hildebrand | |
| 5,061,630 | A | 10/1991 | Knopf et al. | |
| 5,101,883 | A | 4/1992 | Kinmartin et al. | |
| 5,407,130 | A * | 4/1995 | Uyeki et al. | 237/12.3 B |
| 5,725,048 | A * | 3/1998 | Burk et al. | 165/42 |
| 5,890,371 | A | 4/1999 | Rajasubramanian et al. | |
| 6,003,593 | A | 12/1999 | Halligan | |
| 6,038,877 | A | 3/2000 | Peiffer et al. | |
| 6,092,375 | A * | 7/2000 | Denniston | 62/94 |
| 6,138,749 | A | 10/2000 | Kawai et al. | |
| 6,889,512 | B2 | 5/2005 | Ebara et al. | |
| 7,025,159 | B2 | 4/2006 | Smith et al. | |
| 7,032,393 | B2 | 4/2006 | Tamai et al. | |
| 7,380,586 | B2 | 6/2008 | Gawthrop | |
| 2005/0138941 | A1 * | 6/2005 | Kikuchi | 62/178 |
| 2008/0179040 | A1 * | 7/2008 | Rosenbaum | 165/61 |
| 2008/0236181 | A1 * | 10/2008 | Zhu et al. | 62/239 |
| 2009/0088062 | A1 * | 4/2009 | Major et al. | 454/70 |
| 2010/0225264 | A1 * | 9/2010 | Okuda et al. | 318/473 |
| 2011/0045326 | A1 * | 2/2011 | Leuthner et al. | 429/72 |
| 2011/0076540 | A1 * | 3/2011 | Ronning et al. | 429/120 |

* cited by examiner

*Primary Examiner* — Stephen Avila
(74) *Attorney, Agent, or Firm* — William D. Lanyi

(57) ABSTRACT

A method and apparatus for controlling the temperature of batteries in a hybrid marine vessel utilize a compartment to store the batteries and various conduits to conduct air to and from that compartment. A heat exchanger can draw air from the compartment and cool the air for use in the cabin of the marine vessel. The air from the cabin can be directed into the compartment to provide a flow of air that carries heat away from the batteries in the compartment and toward the heat exchanger.

18 Claims, 5 Drawing Sheets

TEMPERATURE CONTROL SYSTEM FOR A HYBRID VEHICLE

BACKGROUND OF THE INVENTION

1. Field of the Invention

The present invention is generally related to a hybrid vehicle and, more particularly, to a hybrid marine vessel that selectively combines the function of cooling the cabin temperature with the function of removing heat from a battery storage compartment.

2. Description of the Related Art

Many different systems are known, to those skilled in the art of marine vessels, for the purpose of removing heat from heat emitting components and transferring that heat to other sections of the system where the heat can be removed by a heat exchanger or, alternatively, can be used for the purpose of increasing the temperature of other portions of the marine vessel.

U.S. Pat. No. 4,898,325, which issued to Sakurada on Feb. 6, 1990, describes an automobile air conditioner with separate flow adjustment for central and side vents. The system has a central air outlet and a pair of left and right air outlets arranged at left and right sides of the central air outlet, which are provided at least one of front and rear portions of the vehicle compartment. A center vent passage extends from a first diverging point and leads to the central air outlet. A side vent passage extends from the first diverging point in a manner separated from the center vent passage and leads to the left and right air outlets. The side vent passage has a pair of left hand and right hand vent passages extending from a second diverging point located at a different position from the first diverging point and leading to the left and right outlets, respectively. A flow rate ratio-adjusting door is arranged at the second diverging point for adjusting the ratio between the flow rates of air delivered into the left hand and right hand vent passages.

U.S. Pat. No. 4,899,809, which issued to Takenaka et al. on Feb. 13, 1990, describes an automotive air conditioner system with automatic adjustment of discharge air temperature. The system controls the temperature of air to be discharged into a cabin of a vehicle in an automatically air conditioner system of an automotive vehicle. The air conditioner system is provided with a cooling unit and a heating unit for cooling and heating conditioning air in the air conditioner system for delivery to the cabin of the vehicle. The air conditioner system includes a mechanism for mixing the cooling air and the heating air in a stepwise manner so as to generate a controlled temperature of conditioning air to be discharged into the vehicle cabin with a moderate adjustment in transition so as to maintain a desired vehicle cabin temperature.

U.S. Pat. No. 5,042,566, which issued to Hildebrand on Aug. 27, 1991, describes a heating or air conditioning system for a motor vehicle. Improved air conditioning of the rear seat area of a motor vehicle is achieved substantially independently from the front seat area in a heating or air conditioning system having means for controlling the temperature of a supply air via a front seat control unit by employing a front air flap with a cool air passage at the inlet of a heat exchanger. A front seat air mix chamber is connected with a rear seat air mix chamber having a rear seat air duct, a rear seat foot duct, and a rear seat air-mix flap with a cool air passage therethrough to control the proportion of cool and warm air entering the ducts.

U.S. Pat. No. 5,061,630, which issued to Knopf et al. on Oct. 29, 1991, describes a laboratory apparatus for optional temperature controlled heating and cooling. It comprises a block of one or more Peltier elements which, with one of their thermal poles, are in thermal contact with an essentially rectangular block of heat conducting metal, and with the other pole are in thermal contact with a heat exchanger, this latter being thermally insulated from the metal block. One of the outer surfaces of the rectangular metal serves as a working outer surface for heating and cooling the samples.

U.S. Pat. No. 5,101,883, which issued to Kinmartin et al. on Apr. 7, 1992, describes a method of assembly of single and multi-zone vehicle heating and air conditioning systems. A vehicle heating and cooling system has a distribution separated into two channels by a baffle for supplying separate air streams to the passenger and driver sides of the vehicle compartment. Two temperature control doors associated with the heater core and evaporator separately admit an air mix to the two channels for independent control of driver and passenger side temperatures.

U.S. Pat. No. 5,890,371, which issued to Rajasubramanian et al. on Apr. 6, 1999, describes a hybrid air conditioning system and a method therefore.

The system is intended to condition the air within an enclosure which houses heat producing equipment. It includes a passive heat removal system, for precooling the air, and a thermal electric temperature control system in conjunction with the passive heat removal system to achieve additional cooling, temperature control and heating.

U.S. Pat. No. 6,003,593, which issued to Halligan on Dec. 21, 1999, describes an automotive vehicle climate control system. The system is capable of simultaneously providing fully heated air exiting one air outlet while also providing fully cooled exiting from a second air outlet. Another aspect of the system provides simultaneous and independently controlled air volumes exiting from two different air outlets while receiving air through one or more common air inlets.

U.S. Pat. No. 6,038,877, which issued to Peiffer et al. on Mar. 21, 2000, describes a modular low pressure delivery vehicle air conditioning system. The system comprises a self-contained refrigeration power cell, a heat exchanger remotely located from the refrigeration power cell, and a low pressure refrigerant communication circuit operably coupling the refrigeration power cell to the heat exchanger. The refrigeration power cell comprises a compressor, a condenser, an expansion device, and an evaporator which are serially coupled to form a high pressure closed refrigeration circuit.

U.S. Pat. No. 6,138,749, which issued to Kawai et al. on Oct. 31, 2000, describes an automotive air conditioner with vent and air mixing door interlocking mechanism. A motor vehicle air conditioner having a structure that reduces production costs is described. Main and sub air-mixing doors and an inner-air FOOT door are mechanically interlocked with a single air mixing door actuator. The shape of an engagement hole of a main link plate of a door interlock device is formed to correspond to an operation pattern to rotate the main and sub air-mixing doors from the maximum cool and maximum hot settings.

U.S. Pat. No. 6,889,512, which issued to Ebara et al. on May 10, 2005, describes an on-vehicle air conditioner. It allows the system to perform cooling, heating, dehumidification or other processes on vehicles such as hybrid cars taking electricity and gasoline as energy sources.

U.S. Pat. No. 7,025,159, which issued to Smith et al. on Apr. 11, 2006, describes a cooling system for a vehicle battery. The vehicle does not use air from the vehicle passenger compartment, but rather, taken in ambient air from outside the vehicle. When the temperature of the ambient air outside the vehicle is low enough, the air is moved through a duct system by a pair of fans and blown across a battery assembly. When the temperature of the ambient air outside the vehicle is too warm to cool the battery directly, it is first passed through an evaporator coil where it exchanges heat with a refrigerant, prior to being blown across the battery assembly.

U.S. Pat. No. 7,032,393, which issued to Tamai et al. on Apr. 25, 2006, describes a climate cooling control system and method for hybrid vehicles. The methods are intended for controlling the climate cooling in the passenger cabin of a hybrid motor vehicle. The apparatus includes an internal combustion engine capable of being started and temporarily stopped, an air conditioning compressor and a dedicated electric compressor motor coupled to drive the air conditioning compressor. Moreover, the sensors are coupled to monitor selected parameters associated with the motor vehicle. An electronic controller is coupled to the internal combustion engine, the compressor motor and the sensors.

U.S. Pat. No. 7,380,586, which issued to Gawthrop on Jun. 3, 2008, describes a climate control system for hybrid vehicles using thermoelectric devices. The system provides a system for controlling the climate of a hybrid is vehicle. The system includes a thermoelectric module, a heat exchanger, a pump, and a valve. The thermoelectric module includes thermoelectric elements powered by electric energy. The thermoelectric elements emit or absorb heat energy based on the polarity of the electrical energy provided. A tube containing coolant runs proximate the thermoelectric elements. To aid in the transfer of heat energy, a blower is provided to generate an air flow across the thermoelectric elements and the tube. The coolant is provided from the thermoelectric module to a heat exchanger that heats or cools the air flow provided to the cabin of the vehicle. The pump and valve are in fluid communication with the heat exchanger and thermoelectric module. The pump pressurizes the coolant flow through the tube and coolant lines. In a cooling mode, the valve is configured to selectively bypass the engine coolant system of the vehicle.

The patents described above are hereby expressly incorporated by reference in the description of the present invention.

In a hybrid marine vessel, several tasks must be performed in conjunction with the heating, ventilating and air conditioning (HVAC) system. In addition, marine vessels have significantly limited space in which to perform these functions which include the removal of heat from the battery storage system and the maintaining of a desirable temperature in the cabin and other living spaces of the vessel. In addition to these limitations, it is expected that a marine vessel will experience temperature variations that will require cooling under some conditions and heating under other conditions. It would therefore be significantly beneficial if a system could be provided that uses the existing components of the HVAC system and the battery charging and discharging system of the marine vessel for the purpose of controlling the temperatures throughout the vessel. It would be particularly advantageous if the need for additional components could be avoided while accomplishing these other tasks.

SUMMARY OF THE INVENTION

A method for controlling battery temperature on a hybrid vehicle, according to a preferred embodiment of the present invention, comprises the steps of providing a compartment which is configured to contain a battery or a plurality of batteries, providing a cabin in which a passenger or operator of said vehicle can perform functions associated with the operation of the vehicle, providing a heat exchanger, conducting a first flow of air through the compartment and in thermal communication with the battery, conducting a second flow of air through the cabin, directing the second flow of air out of the cabin and into the compartment, directing the first flow of air out of the compartment and into the heat exchanger, conducting a third flow of air through the heat exchanger, and directing the third flow of air out of the heat exchanger and into the cabin. In most embodiments of the present invention, the compartment is configured to contain a plurality of batteries. In one particularly preferred embodiment of the present invention, the compartment is configured to contain 48 batteries with each of the batteries having a nominal voltage of approximately 19 volts. The arrangement and interconnection of the batteries result in a nominal voltage of approximately 300 volts DC. The compartment is disposed in the bilge of a marine vessel and sealed to prevent undesirable fluid communication between the bilge and the internal cavities of the compartment. In addition, the walls of the compartment are configured to at least partially insulate the internal cavities of the compartment from the temperature and humidity in the bilge.

The preferred embodiments of the present invention will be described in terms of flows of air that are conducted and directed through and between various portions of the structure. However, it should be understood that the air that is referred to as the "first flow of air", in the example, can be the same air that is also referred to as the "second flow of air" in relation to another cavity or another structure. In addition, the names given to the air flows do not relate to the order or location of the air flow. These identifications are used for the purpose of specifically describing the manner in which the air is conducted and directed through and between the various cavities of the temperature control system.

As will be described in greater detail below, the compartment comprises a U-shaped cavity which, in turn, comprises a first arm and a second arm with a central portion connected between the first and second arms. This particular shape of the compartment is not limiting to the preferred embodiments of the present invention, but provides a convenient and efficient structure that allows the air to be directed to flow in thermal communication with the batteries and satisfy several intended purposes. The preferred embodiments of the present invention are intended to efficiently use various components and conduits of the ventilation system for multiple purposes and allow those conduits, compartments, and components to be connected in selective ways that efficiently uses the air passing through those compartments to transfer heat in desired ways.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
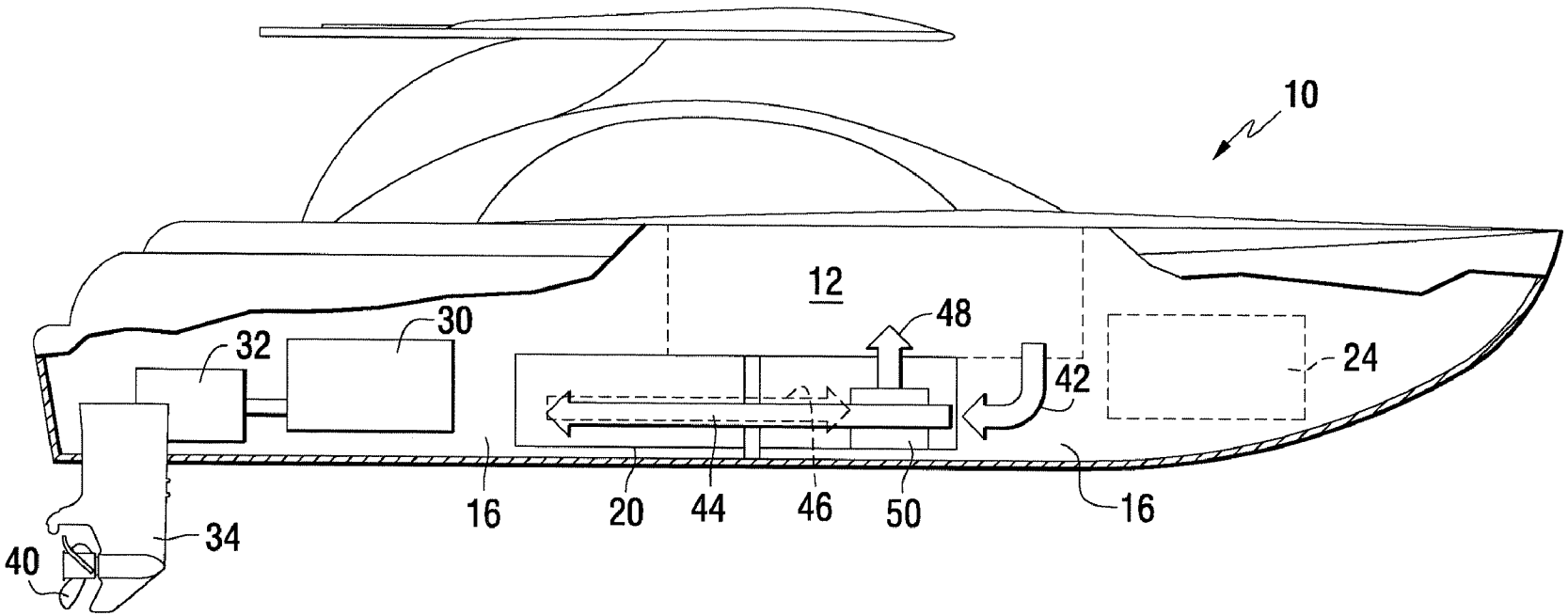
FIG. 1 is a simplified representation of a marine vessel with a compartment in its bilge for containing a plurality of batteries that are cooled by the flow of air from the cabin of the marine vessel.

Throughout the description of the preferred embodiment of the present invention, like components will be identified by like reference numerals.

FIG. 1 is a highly schematic and symbolic representation of a marine vessel 10 that is intended to show the relative positions of various components and systems that are related to the preferred embodiments of the present invention. In the marine vessel 10, a cabin area 12 is provided in which a passenger or operator of the vehicle can perform functions that are associated with the operation of the vehicle. As an example, the operator of the marine vessel 10 can steer or control the speed of the marine vessel by manipulating various control systems located in or near the cabin 12. In addition, passengers on the marine vessel can use the cabin area to relax and enjoy the various functions provided by a pleasure craft. Below the cabin 12 is a bilge area 16 in which a compartment 20 is located. It should be understood that the various spaces and cavities provided by the compartment 20 are separated from the bilge 16 to prevent water that may be located in the bilge from entering the cavities and spaces within the structure of the compartment 20. In addition, to the degree that is possible under the circumstances, the walls of the compartment 20 are at least partially insulative to inhibit the free flow of heat from the bilge 16 into the internal spaces of the compartment 20. In a preferred embodiment of the present invention, a plurality of batteries is contained within the compartment 20 as will be described in greater detail below. In front of the compartment 20, various electrical power converters are contained in the region identified by reference numeral 24. Behind the compartment 20, and in the bilge area, one or more engines 30 are supported and connected in torque transfer relation with electric motors and generators 32 and with various gear arrangements that transfer torque from the engines 30 to the marine drive units 34. In the example shown in FIG. 1, the marine drive unit is the type that comprises a generally vertical driveshaft that provides torque to a propeller 40. It should be understood that alternative types of marine drive units can also be used in conjunction with the preferred embodiments of the present invention. As an example, sterndrives and other types of marine propulsion systems can be used in conjunction with the hybrid system of the marine vessel 10.

With continued reference to FIG. 1, the airflow associated with the compartment 20 is represented by arrows. As an example, arrow 42 represents air that is drawn from the cabin 12 and conducted into the internal cavities of the compartment 20. Arrow 44 represents the flow of air through a portion of the compartment 20 and arrow 46 represents the flow of air in a forward direction within another cavity inside the compartment 20. Arrow 48 represents the flow of air into the cabin 12. It should be understood that the arrows in FIG. 1 are intended to represent a very basic illustration of airflow into, through, and out of the compartment 20 that is primarily intended to provide battery storage. In addition, a heat exchanger 50 is provided to remove heat from the air after it is passed through at least a portion of the battery compartment 20.

Figure 2:
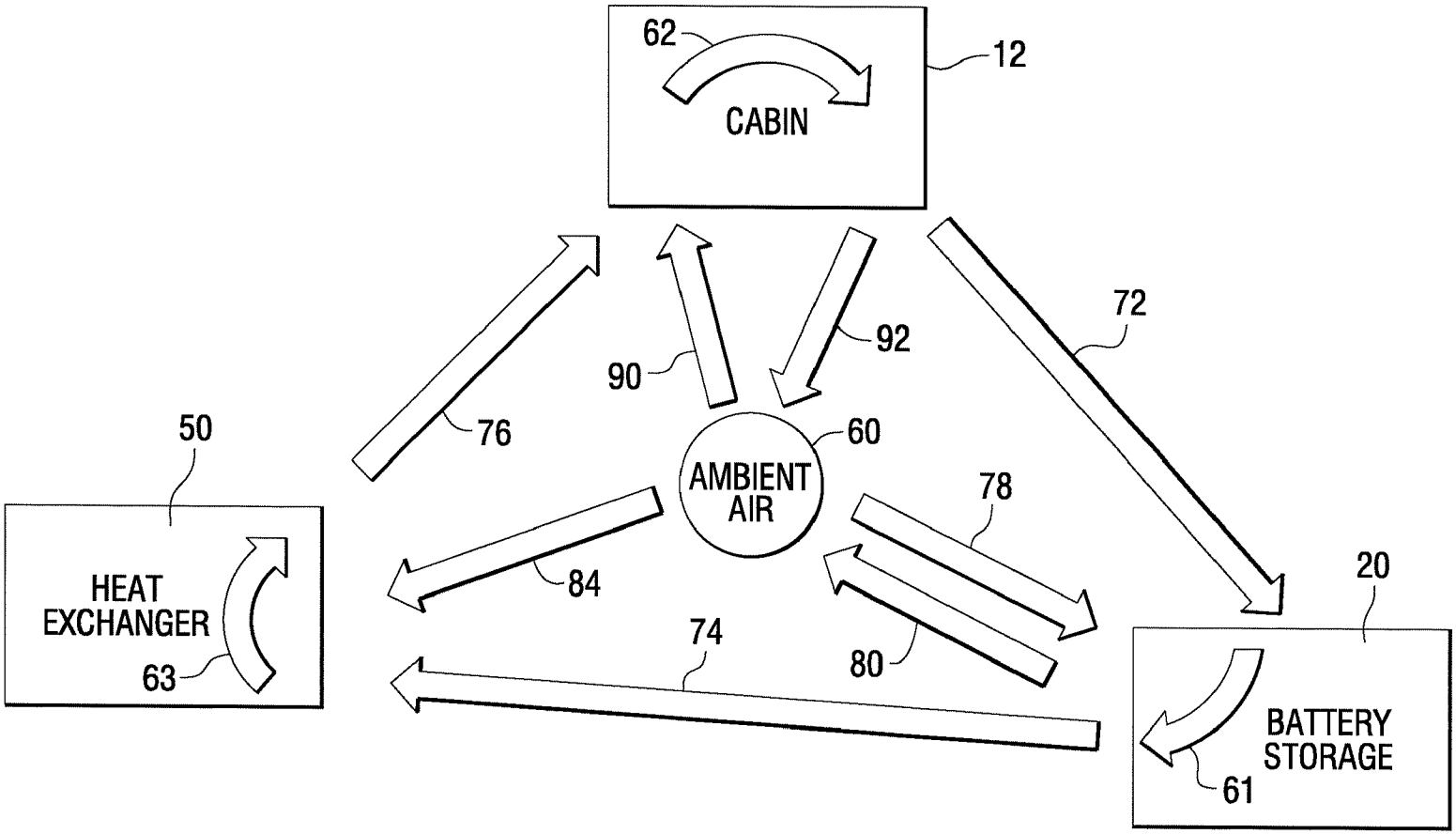
FIG. 2 is a schematic representation of various air flows showing how both ambient and conditioned air can be used to cool the cabin of the marine vessel and the manner in which air from the cabin is used to cool the batteries prior to the passage of that air into and through the heat exchanger of an HVAC system.

To describe the basic functions that the preferred embodiments of the present invention are expected to perform, FIG. 2 is a highly simplified illustration that shows the various airflows that occur during the various operational steps of the preferred embodiments of the present invention. The cabin 12, battery storage compartment 20, and heat exchanger 50 are represented by block diagrams in FIG. 2 with a plurality of arrows intended to show the optional directions of airflow within the system. The compartment 20 is provided to contain one or more batteries within its internal compartments and, in a particularly preferred embodiment of the present invention, is configured to contain 48 batteries that are connected to each other in a way that provides a nominal voltage of approximately 300 volts.

In the simplified diagram of FIG. 2, the air surrounding the marine vessel 10, which is described above in conjunction with FIG. 1, is identified by reference numeral 60 in FIG. 2. It should be understood that the ambient air 60 can be at any place outside the basic structural components of the preferred embodiments of the present invention. A first flow of air 61 is conducted through the compartment 20 and in thermal communication with the one or more batteries contained within it. A second flow of air 62 is conducted through the cabin 12. A third flow of air 63 is conducted through the heat exchanger. The third flow of air is typically moved by a blower or fan. Arrow 72 illustrates the second flow of air being directed out of the cabin 12 and into the compartment 20. This provides air which flows in thermal communication with the batteries and removes heat therefrom. When the air leaves the cabin 12, it carries some heat from the cabin, but is normally expected to be generally cooler than the temperature of the batteries within the compartment 20. Therefore, even if heat is being generated within the cabin 12 and carried away by the second flow of air 62 and the air 72 which is directed from the cabin 12 to the compartment 20, it is expected to serve a useful purpose in removing additional heat from the batteries. Arrow 74 represents the step of directing the first flow of air 61 from the compartment 20 into the heat exchanger 50 with the assistance of a blower within the heat exchanger and, in certain preferred embodiments of the present invention, with additional assistance of fans and blowers located in conduits which extend from the cabin 12 to the compartment 20 and from the compartment 20 to the heat exchanger 50. The operation of some of these blowers will be discussed below, but it is understood that those skilled in the art of ventilation realize that air is caused to flow within and between these compartments in response to the activation of the blowers. Therefore, the actuation of a particular fan or blower will not be identified in relation to every mention of an airflow. In addition to the steps described above, the present invention directs the third flow of air 63 from the heat exchanger 50 to the cabin 12 as represented by arrow 76. As described above, this third flow would be expected to be induced by a blower within the heat exchanger, or immediately adjacent to it and will not necessarily be described or identified every time an air flow is mentioned.

With continued reference to FIG. 2, it should be understood that air can be drawn into the compartment 20, as represented by arrow 78, in order to provide air to cool the batteries other than the air obtained from the cabin 12. In addition, certain embodiments of the present invention can direct air, as represented by arrow 80, out of the compartment 20 and into the ambient air surrounding the vessel 10 without causing that air to flow into the heat exchanger. In addition, it should be understood that air can be drawn by the heat exchanger 50, as represented by arrow 84, from the ambient air 60 under certain circumstances. For example, if a significant amount of heat is generated by the batteries in the compartment 20, the system can elect to discharge that heat into the ambient air surrounding the vessel, as represented by arrow 80, and draw air into the heat exchanger 50, as represented by arrow 84, in order to avoid the significant amount of work that would otherwise be necessary for the heat exchanger 50 to cool the hot air from the compartment 20 represented by arrow 74. This decision would be made based on the temperature of the air flowing out of the compartment 20.

It should also be understood that under certain circumstances, air can be drawn from the ambient surroundings and directed into the cabin 12 as represented by arrow 90. This would occur on generally cool days when it is desirable to have fresh air directed into the cabin 12, but not necessarily cool air from a heat exchanger 50. Similarly, the air from the cabin 12 can be discharged to the ambient surroundings as represented by arrow 92 rather than to the compartment 20, particularly when the batteries are not being charged or discharged and relatively little heat is being created in the compartment 20. In addition, the air from the compartment 20 can be discharged as indicated by arrow 80 to the ambient surroundings when ambient air, by arrow 78, is used to remove a small amount of heat from the batteries under those conditions when the batteries are not generating significant heat.

It should be understood that the purpose of FIG. 2 is to illustrate that many different optional connections are possible in conjunction with various preferred embodiments of the present invention. With the arrangement that will be described in greater detail below, it is possible to use blowers and other air flow inducting devices at or near the various conduit junctions to control the flow the air into and out of the various devices so that the air can be cooled on hot days for use in the cabin 12 or the air can be drawn from the ambient surroundings without cooling on days when an air conditioner is not needed. Similarly, the battery storage compartment 20 may be need significant heat reduction during periods of time when the batteries are charging or discharging, particularly on hot days, while requiring very little heat reduction on cool days when the batteries are not being charged or discharged. On many days when the ambient heat is not excessive, the air taken from the cabin 12 will be sufficiently cool, relative to the battery temperature in the compartment 20, to be used to draw heat from the batteries, as represented by arrows 72 and 61 in FIG. 2. All of these options are possible through the use of various fans and blowers located within the conduits of the preferred embodiments of the present invention. Therefore, even though all of these fans and blowers are not shown in the illustrations, it should be understood that they can be used for these purposes and those skilled in the art of hybrid marine vessels are aware of the means and techniques that can be used for these purposes.

Figure 3:
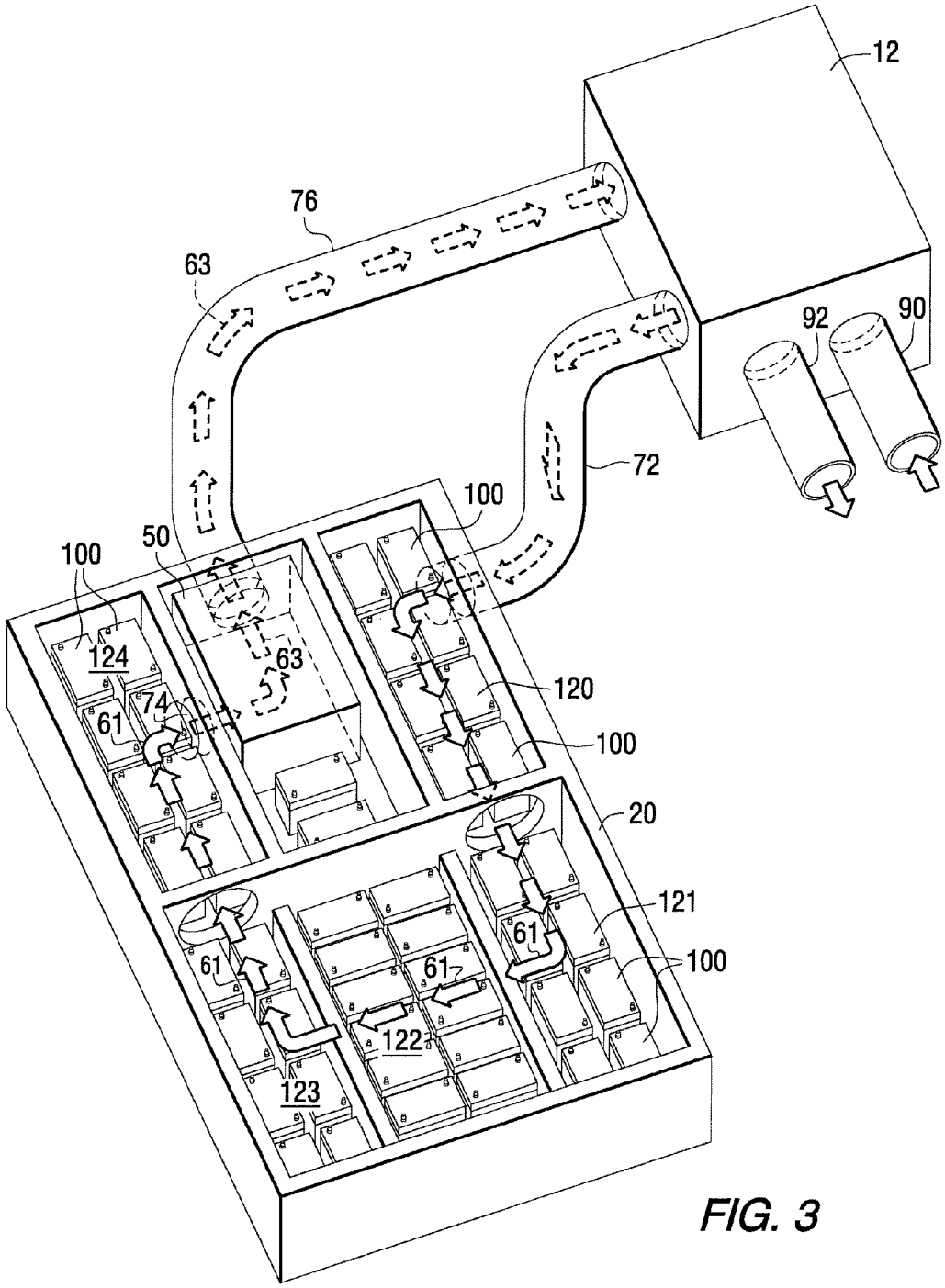
FIG. 3 is an isometric representation of the compartment connected to a symbolic representation of the cabin of the marine vessel.

FIG. 3 is an isometric representation of the compartment 20 showing the internal cavities that are configured to store a plurality of batteries 100. The compartment 20, as described above in conjunction with FIG. 1, is disposed in the bilge portion of the marine vessel 10 and insulated from water which may be contained within the bilge and, to the degree possible, from the heat transfer that could otherwise occur because of the heat emitting components located in the bilge of the marine vessel.

FIG. 3 shows the compartment 20 which is generally U-shaped with regard to the air passages provided by openings and blowers. As an example, the first flow of air 61 is directed within a first arm of the U-shaped cavity toward a central portion of the U-shaped cavity. The first arm comprises cavities 120 and 121 in FIG. 3. The central portion comprises cavity 122 in FIG. 3. The first flow of air 61 then flows away from the central portion 122 through a second arm which comprises cavities 123 and 124. As shown in FIG. 3, the second arm of the compartment 20 is configured to conduct the first flow of air 61 toward the heat exchanger 50. It can be seen that reducing a pressure within the heat exchanger 50 will draw the first flow of air 61 out of the compartment and into the heat exchanger 50. In other words, a blower in the heat exchanger 50 will draw air through an opening associated with arrow 74 in FIGS. 2 and 3 and the reduced pressure in that region will cause air to flow along the path represented by arrows 61 in FIG. 3. Additional blowers can be used in conjunction with the conduit associated with arrow 72 to urge the first flow of air 61 into the compartment 20 as the blower associated with arrow 74 urges the first flow of air 61 into the heat exchanger 50 and toward the cabin 12 as represented by arrow 76.

Figure 4:
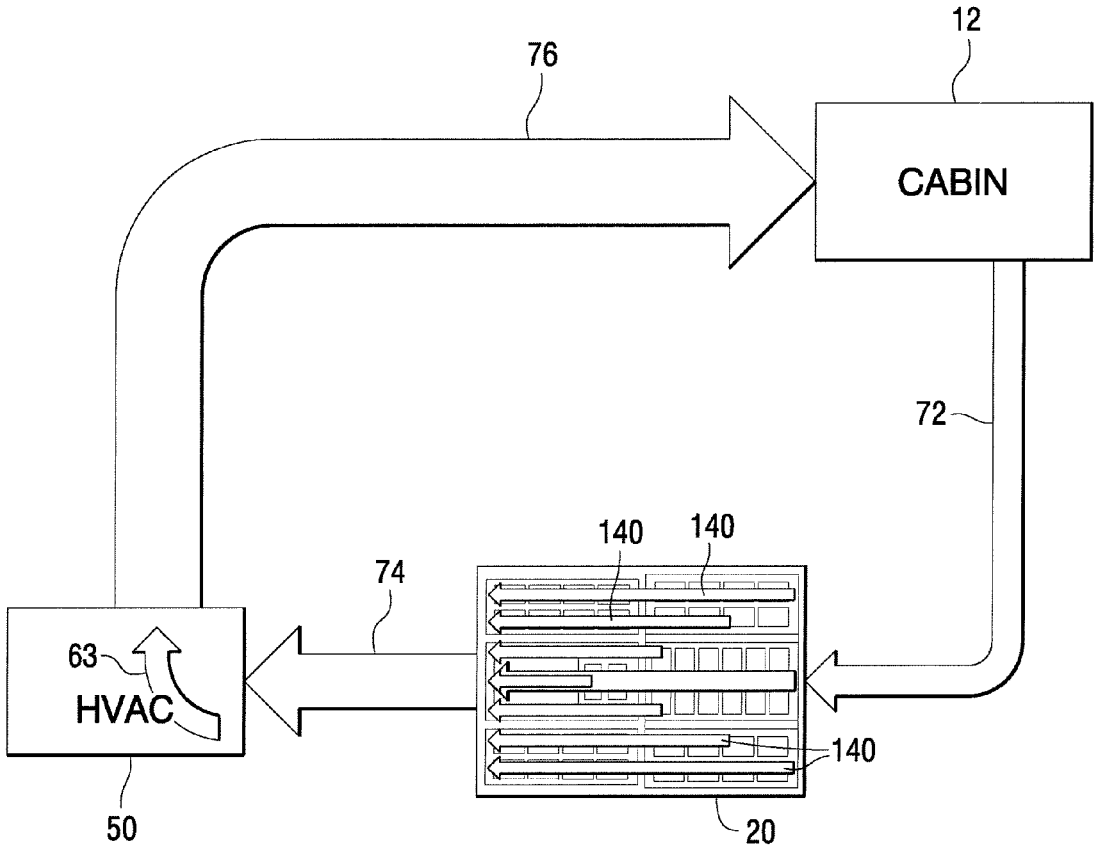
FIG. 4 shows a basic connection of cabin air to a compartment which stores batteries and the connection of a heat exchanger between the compartment and the cabin.

FIG. 4 is a simplified representation of some of the airflows that remove heat from the batteries and cabin area. In FIG. 4, the heat generated by the batteries, within the structure of the compartment, is represented by arrows 140 and the airflows from the cabin 12 are represented by arrow 72 and flow over the batteries within the compartment 20. It should be understood that on hot days the air flowing from the cabin 12 carries heat toward the compartment 20 and is less efficient in removing the heat from the batteries than would be the case on cooler days. However, the air flowing from the cabin 12 is virtually always expected to be cooler than heat generated within the compartment 20 when the batteries are being discharged. The various arrows associated with compartment 20 show the movement of heat from right to left in FIG. 4 and, as represented by arrow 74, this heat flows to the heat exchanger 50 and, after being cooled by the heat exchanger, this conditioned air flows to the cabin 12 to increase the comfort of the passengers. The arrangement shown in FIG. 4 is relatively standard in relation to the various capabilities of the present invention. Cabin air, which is cooler than the air in the compartment 20, is used to remove some of the heat from the batteries and carry that heat to the air conditioner 50. That air conditioned air is is then drawn into the cabin 12.

Figure 5:
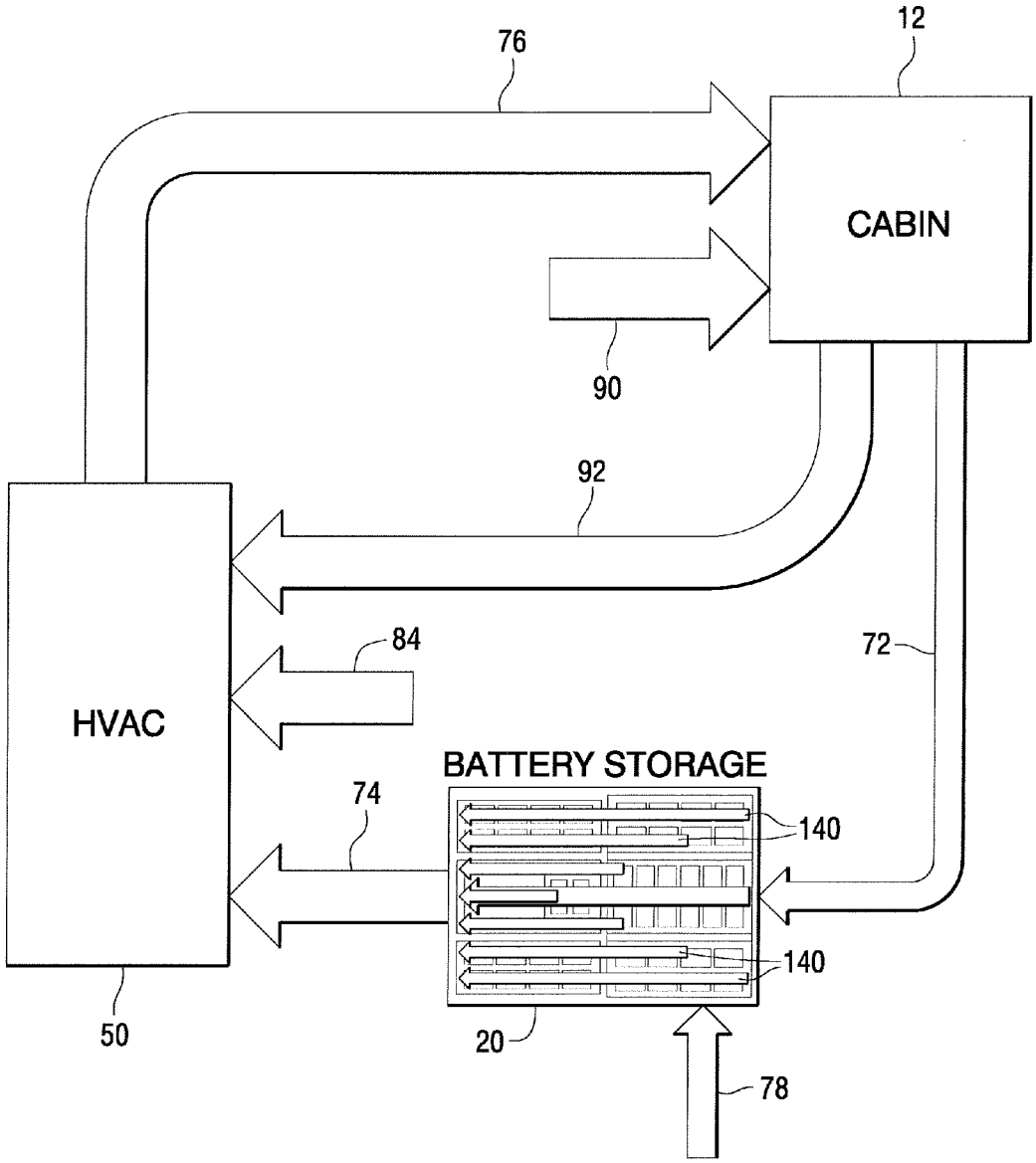
FIG. 5 shows an alternative arrangement of air flows that is possible by directing and conducting air to and from the ambient surroundings associated with the vessel and to and from a heat exchanger provided between the battery storage compartment and the cabin of the marine vessel.

An alternative arrangement is shown in FIG. 5. It shows other possible airflows. From the cabin 12, the air can flow to the compartment 20 as represented by arrow 72. Alternatively, it can flow into the ambient surroundings of the vessel and then from those ambient surroundings to the heat exchanger. This would involve arrows 92 and 84 in FIG. 2. Those reference numerals are used in FIG. 5 for purposes of comparison. From the air conditioner 50, the air can flow as indicated by arrow 76 to the cabin 12 or the cabin 12 can draw air from the ambient surroundings as indicated by arrow 90. The various interconnections that would result in the airflows represented by the arrows in the figures, illustrate the significant flexibility that the embodiments of the present invention make possible.

Although the present invention has been described with particular specificity and illustrated to show various preferred embodiments, it should be understood that alternative embodiments are also within its scope.

I claim:

1. A method for controlling battery temperature on a hybrid vehicle, comprising the steps of:

providing a compartment which is configured to contain a battery;

providing a cabin in which a passenger of said vehicle can perform functions associated with the operation of said vehicle;

providing a heat exchanger;

conducting a first flow of air through said compartment and in thermal communication with said battery;

conducting a second flow of air through said cabin;

directing said second flow of air out of said cabin and into said compartment;

directing said first flow of air out of said compartment and into said heat exchanger;

conducting a third flow of air through said heat exchanger; and directing said third flow of air out of said heat exchanger and into said cabin.

2. The method of claim 1, wherein:

said hybrid vehicle is a marine vessel.

3. The method of claim 2, wherein:

said compartment is disposed in a bilge of said marine vessel.

4. The method of claim 1, wherein:

said compartment comprises a U-shaped cavity, said first flow of air being directed within a first arm of said U-shaped cavity toward a central portion of said U-shaped cavity, through said central portion, and then away from said central portion through a second arm of said U-shaped cavity.

5. The method of claim 4, wherein:

said first arm of said U-shaped cavity is configured to conduct said first flow of air away from said cabin.

6. The method of claim 4, wherein:

said second arm of said U-shaped cavity is configured to conduct said first flow of air toward said heat exchanger.

7. The method of claim 1, further comprising:

reducing a pressure within said compartment by drawing said first flow of air out of said compartment.

8. A method for controlling battery temperature on a hybrid vehicle, comprising the steps of:

providing a compartment which is configured to contain a battery;

providing a cabin in which a passenger of said vehicle can perform functions associated with the operation of said vehicle;

providing a heat exchanger;

conducting a first flow of air through said compartment and in thermal communication with said battery;

conducting a second flow of air through said cabin;

directing said second flow of air out of said cabin and into said compartment;

directing said first flow of air out of said compartment and into said heat exchanger;

conducting a third flow of air through said heat exchanger;

directing said third flow of air out of said heat exchanger and into said cabin; and reducing a pressure within said compartment by drawing said first flow of air out of said compartment.

9. The method of claim 8, wherein:

said pressure reducing step comprises a step of operating a fan to cause said first flow of air to flow out of said compartment and into said heat exchanger.

10. The method of claim 9, wherein:

said pressure reducing step causes said second flow of air to flow out of said cabin and into said compartment.

11. The method of claim 10, wherein:

said hybrid vehicle is a marine vessel and said compartment is disposed in a bilge of said marine vessel.

12. The method of claim 11, wherein:

said compartment comprises a U-shaped cavity, said first flow of air being directed within a first arm of said U-shaped cavity toward a central portion of said U-shaped cavity, through said central portion, and then away from said central portion through a second arm of said U-shaped cavity, said first arm of said U-shaped cavity being configured to conduct said first flow of air away from said cabin, said second arm of said U-shaped cavity is configured to conduct said first flow of air toward said heat exchanger.

13. A hybrid vehicle, comprising:

a compartment which is configured to contain a battery;

a cabin in which a passenger of said vehicle can perform functions associated with the operation of said vehicle;

a heat exchanger;

said compartment being configured to conduct a first flow of air through said compartment and in thermal communication with said battery;

said cabin being configured to conduct a second flow of air through said cabin and direct said second flow of air out of said cabin and into said compartment;

said compartment and said heat exchanger being configured to direct said first flow of air out of said compartment and into said heat exchanger; and said heat exchanger and said cabin being configured to conduct a third flow of air through said heat exchanger and to direct said third flow of air out of said heat exchanger and into said cabin.

14. The method of claim 13, wherein:

said hybrid vehicle is a marine vessel and said compartment is disposed in a bilge of said marine vessel.

15. The method of claim 14, wherein:

said compartment comprises a U-shaped cavity, said first flow of air being directed within a first arm of said U-shaped cavity toward a central portion of said U-shaped cavity, through said central portion, and then away from said central portion through a second arm of said U-shaped cavity.

16. The method of claim 15, wherein:

said first arm of said U-shaped cavity is configured to conduct said first flow of air away from said cabin.

17. The method of claim 16, wherein:

said second arm of said U-shaped cavity is configured to conduct said first flow of air toward said heat exchanger.

18. The method of claim 17, further comprising:

a fan disposed in fluid communication with said heat exchanger and configured to reduce a pressure within said compartment by drawing said first flow of air out of said compartment and through said heat exchanger.

* * * * *